United States Patent [19]

Kerr et al.

[11] 4,121,293

[45] Oct. 17, 1978

[54] INDICATION MEANS FOR INDICATING SUITABLE CONDITIONS FOR THE TRANSFER OF LOADS BETWEEN TWO STATIONS MOVABLE RELATIVE TO EACH OTHER IN A VERTICAL PLANE

[75] Inventors: Andrew Guy Kerr, Edinburgh, Scotland; Robert Arthur Morley, Southport, England

[73] Assignee: Ferranti Limited, Hollinwood, England

[21] Appl. No.: 772,254

[22] Filed: Feb. 25, 1977

[30] Foreign Application Priority Data

Feb. 28, 1976 [GB] United Kingdom ..... 07939/76

[51] Int. Cl.[2] ..... B66C 15/06

[52] U.S. Cl. ..... 364/463; 254/173 R; 340/529; 340/685; 361/242

[58] Field of Search ..... 364/566, 463, 565; 340/267 C, 263, 262; 361/236, 239, 242; 328/1, 127; 214/14; 254/173 R

[56] References Cited

U.S. PATENT DOCUMENTS

| | | | |
|---|---|---|---|
| 2,946,943 | 7/1960 | Nye et al. | 328/127 |
| 3,168,680 | 2/1965 | Morris | 361/242 |
| 3,594,557 | 7/1971 | Anderson | 328/1 |
| 3,921,818 | 11/1975 | Yamagishi | 340/267 C |

*Primary Examiner*—Felix D. Gruber

*Attorney, Agent, or Firm*—Cameron, Kerkam, Sutton, Stowell & Stowell

[57] ABSTRACT

For use with apparatus for transferring a load between two stations movable relative to each other in a vertical plane by means of a crane carried by one of the two stations having a hook assembly for attachment to the load on the other station for lifting the load, a lift-off indicator measures either the relative velocity or relative vertical accelerations of the two stations and from signals representing relative velocity of approach showing values between a maximum positive and a negative, and relative acceleration acting away from the direction of approach indicates conditions suitable for initiating lifting.

6 Claims, 3 Drawing Figures

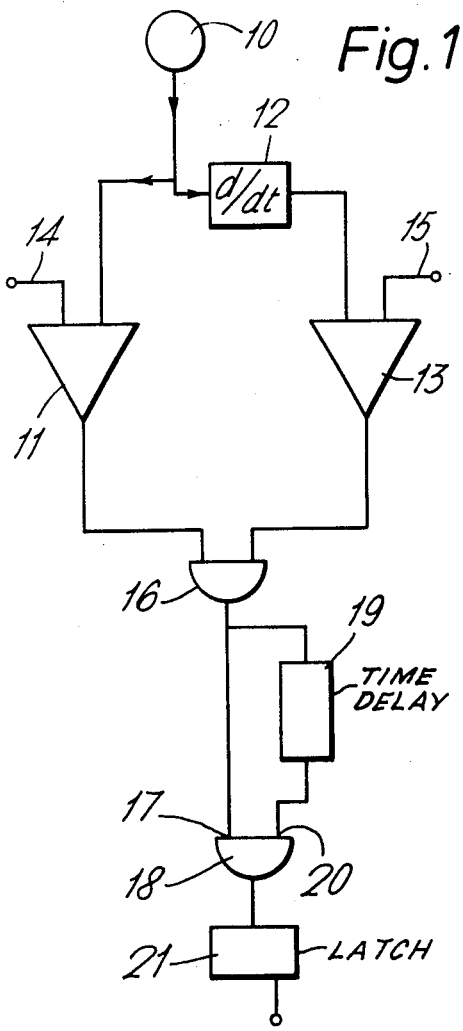
Fig.1.
Fig.2.
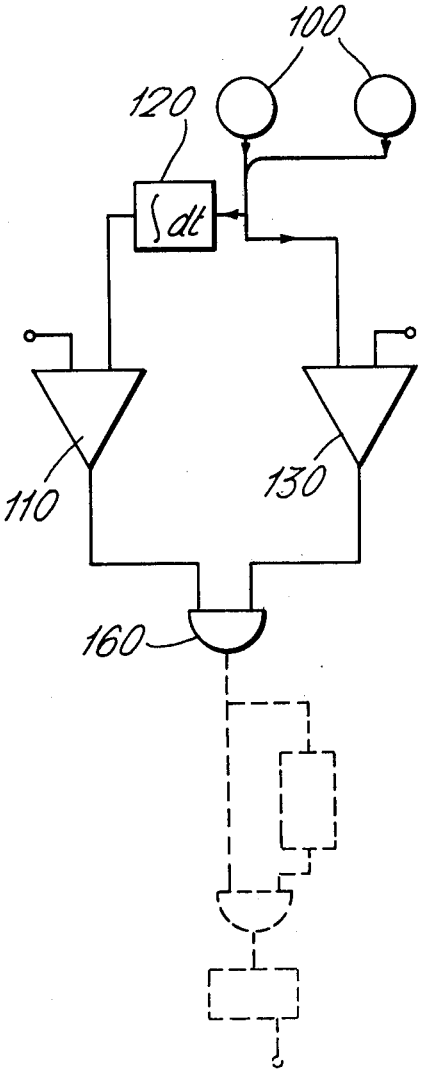

INDICATION MEANS FOR INDICATING SUITABLE CONDITIONS FOR THE TRANSFER OF LOADS BETWEEN TWO STATIONS MOVABLE RELATIVE TO EACH OTHER IN A VERTICAL PLANE

This invention relates to the transfer of loads between two stations movable relative to each other in at least a vertical plane.

Where such transfer is required, for instance between vessels at sea, then care is required in lifting a load from a first of the two vessels, both as the hook assembly of the crane on the second vessel is brought to the first vessel and as the load is lifted.

Vertical motion between the hook assembly and the first vessel can be dangerous to the crew members and the vessel as the hook assembly approaches the deck of the vessel to have the load attached thereto. Also it is desirable for the load to be lifted at such a time and with such a velocity that snatching of the load does not occur at the instant of lift and that it is lifted clear of the vessel before a subsequent impact between the load and the deck of the vessel can occur as a result of vertical relative movement between the crane and the vessel.

Frequently initial vertical movement of a load is slower than relative motion in the direction of lift and the crane operator has to use his skill and experience to choose the optimum part of a vertical oscillatory motion to initiate lifting. In this respect he is frequently hampered by working from a location which makes the judgement of the extent of vertical movements difficult.

It is an object of the present invention to provide an arrangement for indicating suitable conditions for initiating lifting of a load from one of two stations, movable relative to each other in at least a vertical plane, by a crane carried by the other station.

According to the present invention there is provided indication means for indicating conditions suitable for lifting a load from a first of two stations, movable relative to each other in at least a vertical plane, by a crane carried by a second station wherein the crane is adapted to permit the hook assembly, when attached to the load on the first station to follow motion of the first station prior to lifting of the load, the indication means comprising sensing means for sensing relative movement between the stations to produce signals representative of the values of relative velocity and acceleration of the stations and means responsive to the magnitude and/or sense of said signals to provide an indication signal when the relative velocity of approach of the stations is between a maximum positive value and a negative value and the relative acceleration of the stations is acting away from the direction of approach.

The means to provide an indication signal may include threshold means operable to compare a signal representing the relative velocity of approach of the stations with a first reference value to provide a signal when the velocity reaches a predetermined value and operable to compare a signal representing the relative acceleration of the stations with a second reference value to provide a signal when the acceleration in the direction of approach of the stations has a negative value, that is, is acting away from the direction of approach.

The predetermined value of the velocity may be the load lifting velocity of the crane.

The indication means may also include means for detecting that satisfactory conditions are maintained for a preset minimum period of time.

For a crane in which the hook assembly is suspended by a rope and the rope is maintained in tension by a tensioning device, the means for sensing relative movement may comprise a tachogenerator carried by the crane to provide a signal representative of the velocity at which rope is accumulated by and/or payed out from the crane, that is, at which the stations are moving relative to each other, the signal being differentiated to give a signal representative of the relative acceleration.

Alternatively the means for sensing relative movement may comprise one or more accelerometers located so as to sense the vertical acceleration of each station which undergoes movement with respect to the earth, output signals representing the movement of each station being combined to indicate the sense of relative acceleration between the stations, and integrated to provide a signal indicative of the relative velocity between the stations.

In this specification the term "hook assembly" is used to refer to that part of the crane to which a load is attached and is intended to include all other conventional arrangements for load attachment, such as electromagnets and lifting dogs.

Embodiments of the present invention will be described by way of example with reference to the accompanying drawings, in which:

FIG. 1 is a schematic circuit arrangement of a first form of indication means according to the present invention, and FIG. 2 is a schematic circuit arrangement of a second form of indication means according to the present invention.

Figure 3:
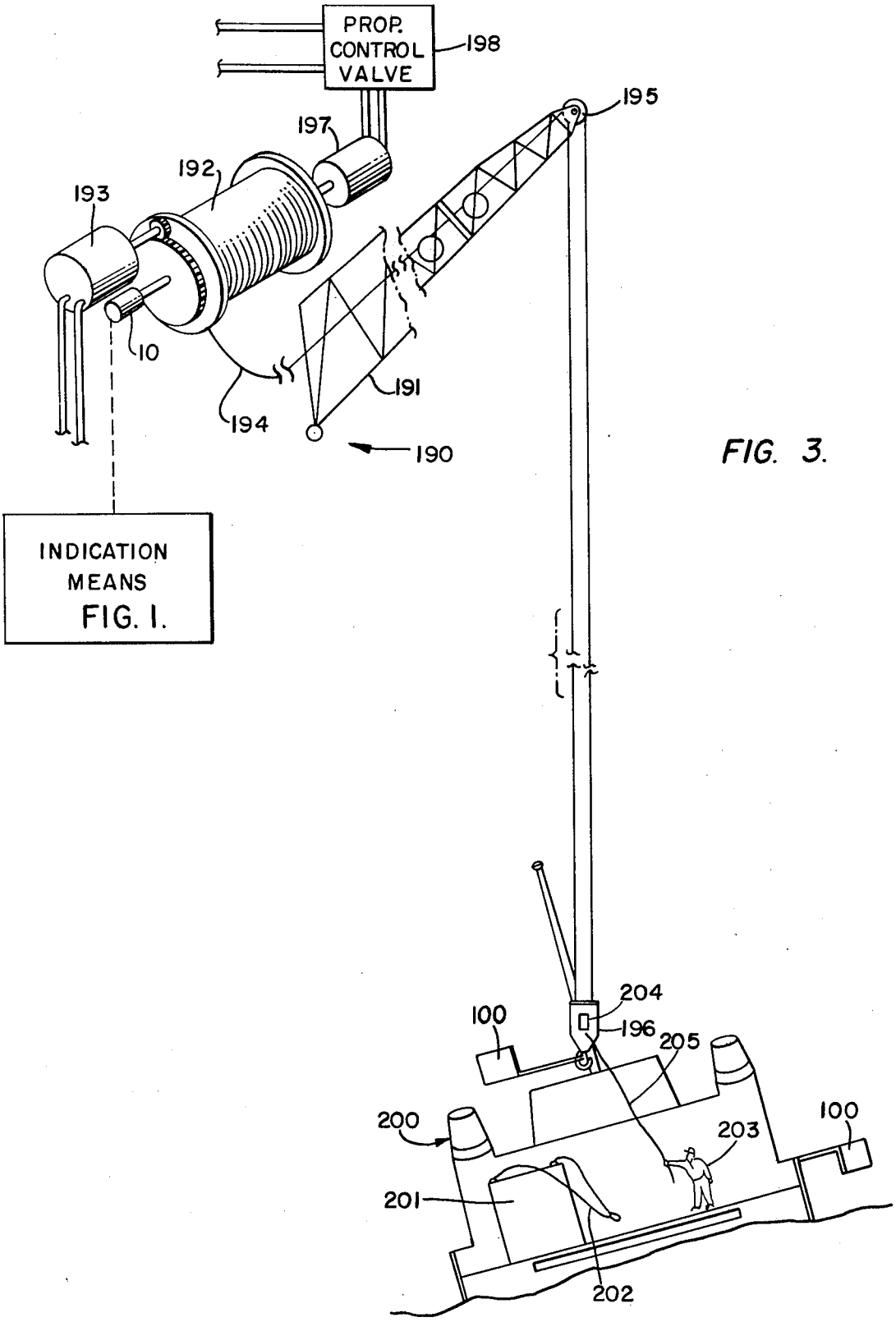
FIG. 3 is a schematic view of a crane control arrangement.

For the purpose of this example it will be assumed that the first and second stations are respectively a supply vessel and a marine platform, the platform being much larger than the supply vessel and consequently, if caused to make vertical movements by the sea, such movements being much slower than those of the vessel, although possibly of greater amplitude.

The supply vessel may be assumed to oscillate vertically with simple harmonic motion (SHM) and because of the difference in oscillation frequencies between the two stations, to a first approximation the vessel may be considered to undergo SHM relative to the platform.

Considering vertical motion, the criterion for successfully lifting a load from the vessel is that the velocity with which the load is lifted relative to the crane exceeds the vertical velocity of approach of the two stations. Furthermore, the vessel should be slowing down relative to the platform it is approaching, stationary, or beginning to move away from the platform as the load is lifted to maximise the time available for the load to clear the vessel.

Referring to FIG. 1, a first form of indication means is shown suitable for use with a crane, such as that disclosed in Fox et al. U.S. Pat. No. 3,189,195, and Carl et al. U.S. Pat. No. 3,189,196, or in our copending U.S. application Ser. No. 772,253, filed Feb. 25, 1977, and which is hereby incorporated by reference.

Referring to FIG. 3 and as disclosed in the aforementioned, pending application Ser. No. 772,253, a crane 190 is mounted on a first station (not shown) which may be a ship or a marine platform of the fixed or floating type and is arranged so as to make conventional slewing and luffing movement of a jib 191 under the control of an operator at a control station carried by the crane. The crane contains a winch drum 192 driven by a hydraulic motor 193 and upon which drum a crane rope 194 is wound. The rope 194 extends along the jib and over a pulley 195 from which the rope hangs vertically to support a crane hook assembly 196. The winch drum is also connected to be driven by a hydraulic servo motor 197 under the control of an electrically operated proportional control valve 198. The servo motor is not able to provide the lifting capacity of the main motor but is able to respond to control signals and control the drum more rapidly.

A second station 200 comprises a vessel smaller than the one on which the crane is carried which vessel consequently moves with respect to the first station, and therefore the hook assembly, with the prevailing wave motion of the sea. The vessel 200 carries a load 201, which is to be attached to the hook assembly by means of slings 202 and a crew member 203. The hook assembly is suspended by a rope and which contains a tensioning device whereby when the hook assembly is attached to a load on the supply vessel, relative motion between the vessel and the platform is accommodated by the accumulation of rope in, and paying-out of rope from, the crane to maintain a tension in the rope to prevent it becoming slack and snatching on subsequent tautening. In such a crane the tensioning device may comprise a servo motor operable to wind rope onto and off a winch drum of the crane to maintain a predetermined tension therein against the weight of a load to be lifted, the tension in the rope being sensed, for instance, by a transducer mounted on a pulley of the crane jib over which the rope passes.

Where such a tensioning device is employed the indication means of the present invention includes a tachogenerator 10 driven by the winch drum when undergoing servo motion and produces an output voltage related to the velocity at which the drum is rotating at any instant. The velocity signal is fed to one input of a first, or "velocity", comparator 11 and, by way of a differentiating circuit 12, to one input of a second, or "acceleration", comparator 13. The comparators 11 and 13 act as threshold means.

The other input of the velocity comparator 11 is supplied with a preset "velocity" reference voltage by line 14 from a source (not shown) which may be a potentiometer. The inputs are arranged such that the comparator 11 produces an output signal only when the amplitude of the velocity signal falls below the level of the reference voltage.

The other input of acceleration comparator 13 is supplied with a preset "acceleration" reference voltage by a line 15 from a source (not shown) similar to that which provides the velocity reference voltage. The reference acceleration voltage may conveniently be zero so that the comparator 13 is arranged to give an output signal only when the differentiated velocity signal becomes negative in value, that is, when the acceleration is acting away from the direction of approach of the stations.

The output terminals of the comparators 11 and 13 are connected to input terminals of a two input AND-gate 16 which thus produces a signal when the winch drum, and therefore the load, is moving upwards with a velocity which has decreased below a threshold reference value and an acceleration which is acting away from the direction of approach of the stations, that is, when the vessel carrying the load is approaching the crest of a wave.

The velocity reference voltage is preferably chosen at a level corresponding to a relative velocity of approach between the maximum value and zero so that the load prior to initiation of lift is moving in the direction of lift thereby reducing any tendency to snatch at the load as the crane drive is transferred from the tensioning device to the main hoist. The tendency to snatch may be reduced to a minimum by choosing a reference voltage corresponding to a velocity of approach equal to the lifting velocity of the crane so that the load makes a smooth transition from upward motion on the vessel to upward motion on the crane hook assembly.

It will be appreciated that the form of the tensioning device may be other than servo controlled. For instance, a spring loaded system of pulleys may be employed to accumulate slack rope without it being wound onto the drum; the velocity measurement then being made with measurement of the passage of rope over a pulley.

In order to confirm that the conditions indicated as satisfactory to initiate lifting are prevailing, the signal from the gate 16 is fed directly to one input 17 of a two-input gate 18 and by way of a time delay element 19 to a second input 20 of the gate. The delay element introduces a delay of, say, 0.1 second, although this may be altered, so that the gate 18 only produces a condition indication signal when the desired conditions of motion of the vessel have been maintained for the period of the delay. As the indication signal may not persist for the duration of any action taken as a result of the indication, particularly when the drum speed is changed to initiate lifting, the indication signal may be applied to a bistable latch 21 which provides a continuous signal until it is reset.

As an alternative to the measurement of relative velocity between the stations, the sensing of velocity and acceleration may be performed by sensing the acceleration of each station with respect to earth.

Referring to FIG. 2, accelerometers 100 are carried one each by the hook assembly and the platform and produce signals indicative of upward vertical acceleration of the stations. The accelerometers may be of the type described in British Pat. No. 1,362,121 which can be arranged to produce an output signal having a voltage linearly related to the magnitude of the acceleration. The accelerometer signals are combined to give a signal representative of the relative acceleration which is applied directly to one input of an acceleration comparator 130 and by way of an integrating element 120 to a velocity comparator 110. The action of the comparators 110 and 130, the AND-gate 160 and the subsequent circuit shown in broken lines in FIG. 2 corresponds to that of FIG. 1.

It will be appreciated that the accelerometer of the hook assembly may be carried by the load or by the vessel as all three undergo the same motion prior to lift off.

Where the station carrying the crane is not subject to vertical movements, for instance if the platform is on the sea bed or the station is a quayside, the arrangement of FIG. 2 will only require the use of one accelerometer to measure the movement of the load on the vessel.

It will be appreciated that the crane may be carried on the station undergoing the more rapid movement, but in the arrangement of FIG. 2 in which accelerometers are used, where the station carrying the crane is the only one undergoing movement, the accelerometer must be carried by the crane or its station.

It will be appreciated that the circuits shown in FIGS. 1 and 2 can be made more complex, to accommodate more complex movements between the stations if they are of a similar size and movements of the two stations approach the same amplitude and velocity.

What we claim is:

1. Indication means for indicating conditions suitable for lifting a load from a first of two stations, movable relative to each other in at least a vertical plane, by a crane carried by the second station, the crane being adapted to permit a hook assembly, when attached to the load on the first station, to follow the motion of the first station prior to lifting of the load, said indication means comprising sensing means for sensing relative movement between the stations to produce signals representative of the values of relative velocity and relative acceleration of the stations, and means responsive to the magnitude and sense of said signals to provide an indication signal when the relative velocity of approach of the stations is between a maximum positive value and a negative value and when the relative acceleration of the stations is in a direction away from the direction of approach, said means to provide an indication signal including threshold means operable to compare the signal representing the relative velocity of approach of the stations with a first reference value to produce the signal when said velocity reaches a predetermined value and operable to compare a signal representing the relative acceleration of the stations with a second reference value to provide a signal when the acceleration in the direction of approach of the stations has a negative value.

2. Indication means as claimed in claim 1 in which the predetermined value of velocity is arranged to be equal to the value of velocity at which a load can be lifted by the crane.

3. Indication means as claimed in claim 1 for use with a crane in which the hook assembly is suspended by a rope maintained in tension by a tensioning device in which the means for sensing relative movement between the stations comprises a tachogenerator carried by the crane to provide a signal indicative of the velocity at which rope is accumulated by, and payed out from, the crane, and means for differentiating said signal with respect to time to give a signal representative of the relative acceleration of the stations.

4. Indication means as claimed in claim 1 in which the means for sensing relative movement between the stations comprises an accelerometer so located as to sense vertical acceleration of each station which undergoes movement with respect to the earth, means for combining the accelerometer signals to provide a relative acceleration signal indicative of the sense of relative acceleration between the stations, and integration means operable to integrate the relative acceleration signal to provide a signal indicative of the relative velocity between the stations.

5. Indication means as claimed in claim 4 in which acceleration of the station carrying the load is sensed by an accelerometer located on the hook assembly.

6. Indication means as claimed in claim 1 including time delay means operable to receive and delay said indication signal by a preset period of time and two-input gating means arranged to receive said indication signal directly and by way of the delay means, said gating means being responsive to signals applied to both inputs to provide an output signal indicative of satisfactory lifting conditions being maintained for said preset period of time.

* * * * *